United States Patent [19]

Lasso et al.

[11] Patent Number: 4,573,800

[45] Date of Patent: Mar. 4, 1986

[54] BLENDER BULK FEED VALVE

[75] Inventors: Eugene R. Lasso, Freemansburg; John J. Pitsko, Nazareth, both of Pa.

[73] Assignee: Fuller Company, Bethlehem, Pa.

[21] Appl. No.: 680,213

[22] Filed: Dec. 10, 1984

[51] Int. Cl.[4] ..... B01F 13/02

[52] U.S. Cl. ..... 366/101; 406/128

[58] Field of Search ..... 366/101, 106, 107, 341, 366/9, 336, 262; 406/127, 128, 130; 137/625.41, 872, 876; 222/544

[56] References Cited

U.S. PATENT DOCUMENTS

| | | | |
|---|---|---|---|
| 2,718,435 | 9/1955 | Hudspeth | 406/133 |
| 4,042,220 | 8/1977 | Humkey | 366/101 |
| 4,194,845 | 3/1980 | Krambrock | 366/101 |
| 4,285,602 | 8/1981 | Hagerty | 366/101 |
| 4,486,101 | 12/1984 | Brar | 137/625.41 |

*Primary Examiner*—Robert W. Jenkins

*Attorney, Agent, or Firm*—Frank H. Thomson

[57] ABSTRACT

A pneumatic conveying and material blending system which includes a bin having an open vertical column mounted therein with a bottom of a column being spaced from the bottom of the bin. The material inlet is located in the bottom of the bin and a pneumatic conveying system supplies material to be blended from a source to the material inlet and conveys the material upwardly through the column so that the material is discharged from the top of the column in the manner of a geyser whereby it is spread over the top surface of material already in the bin. Material already in the bin flows down through the bin by gravity and is entrained by the upwardly flowing gas stream and conveyed up the column so that material already in the bin is blended with material being supplied to the bin. An annular valve is provided between the column and sidewalls of the vessel to control the quantity of material already in the bin that is entrained into the upwardly flowing gas stream and supply of fresh particulate to thereby control blending. The outlet of the bin is coextensive with the inlet of the bin so that material is drawn out of the central opening of the bottom of the bin.

9 Claims, 10 Drawing Figures

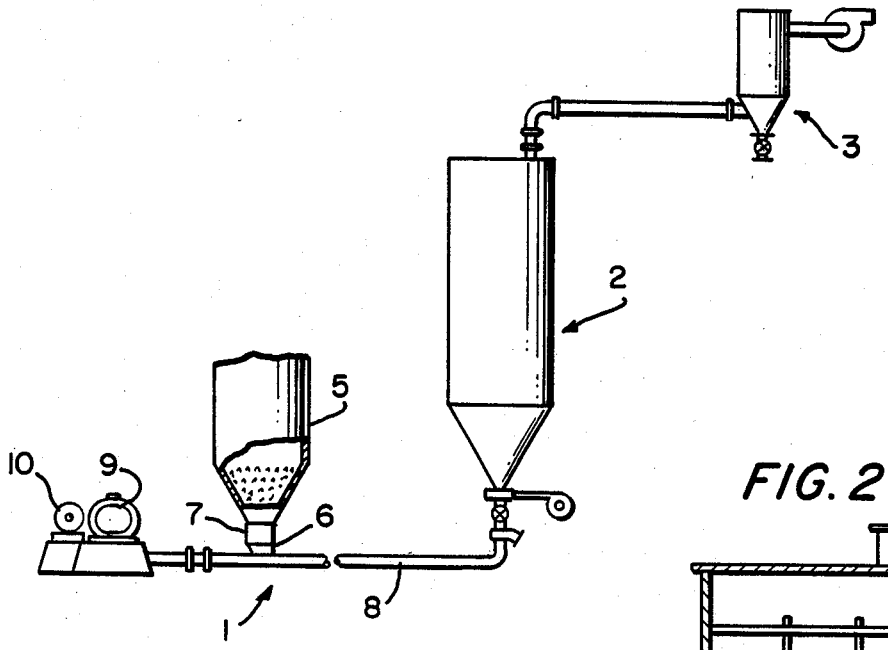
FIG. 1
FIG. 2
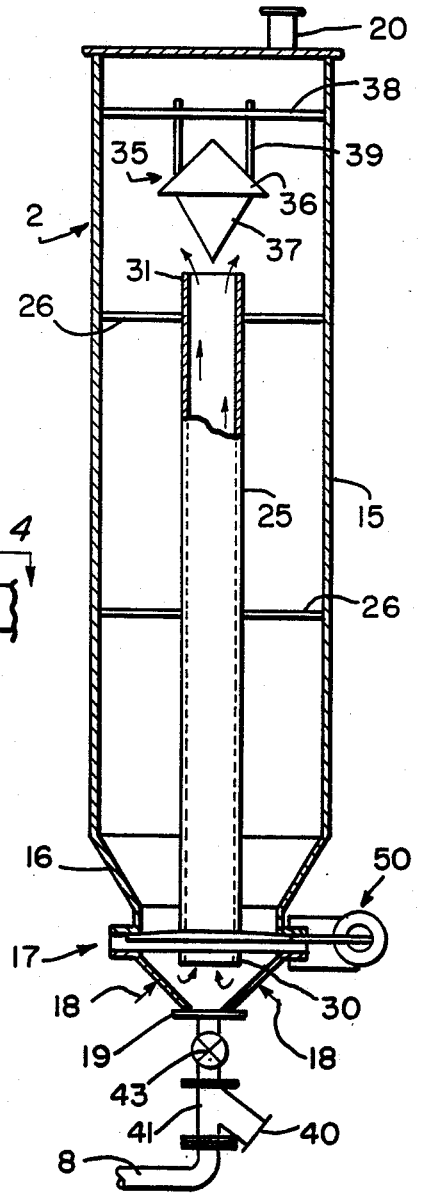
FIG. 3
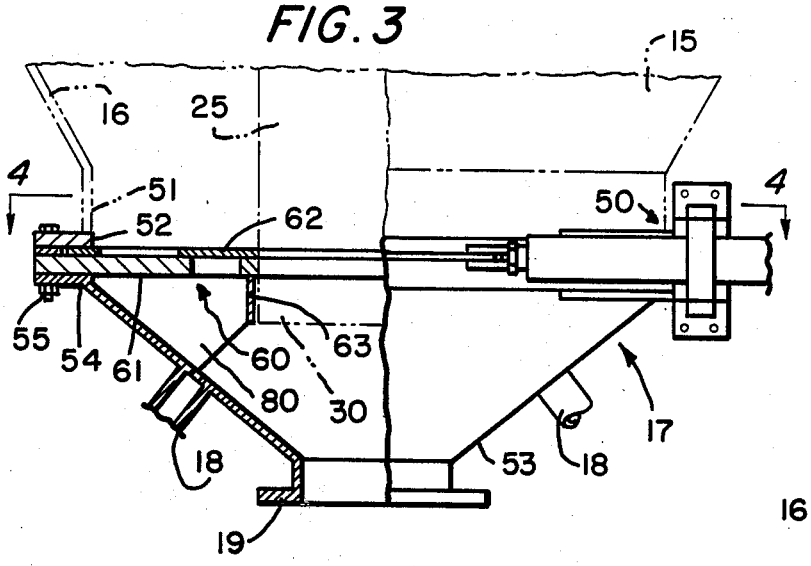

FIG. 4
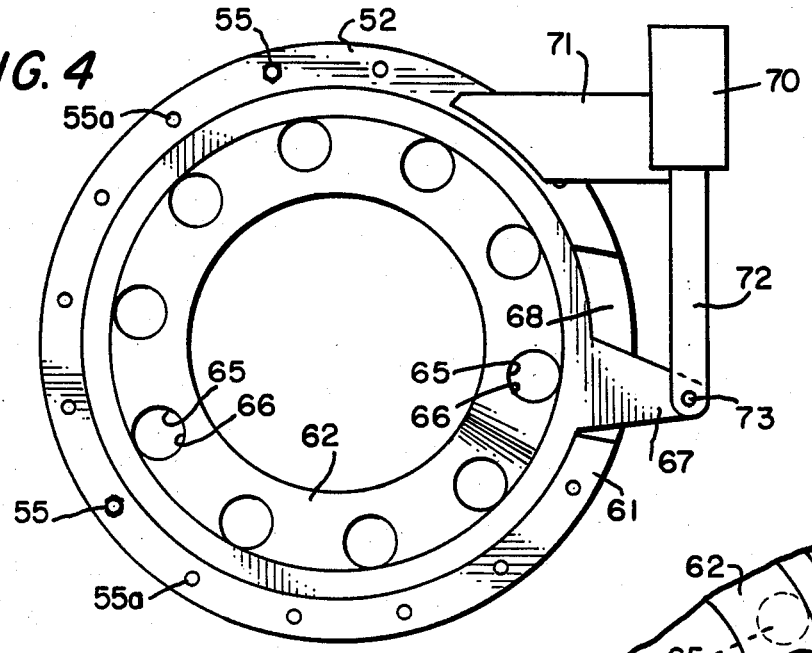
FIG. 5
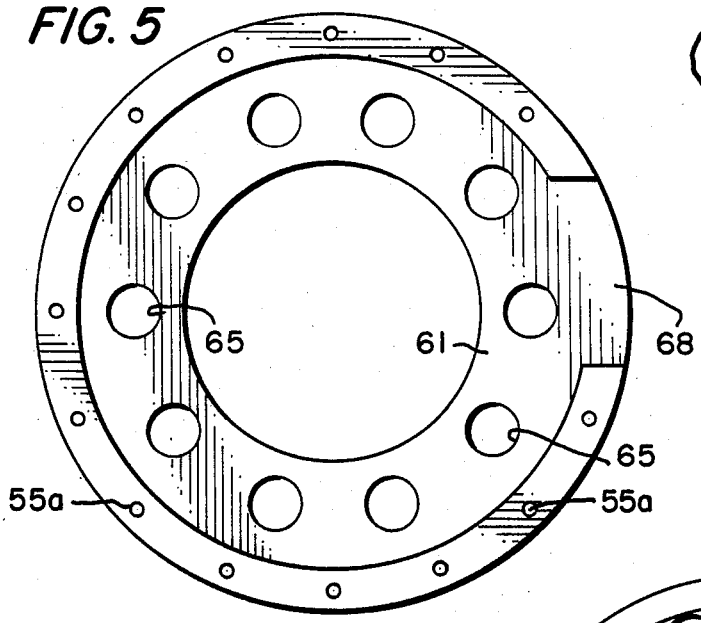
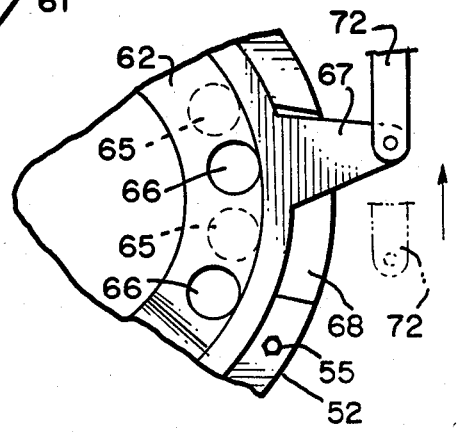
FIG. 7
FIG. 6
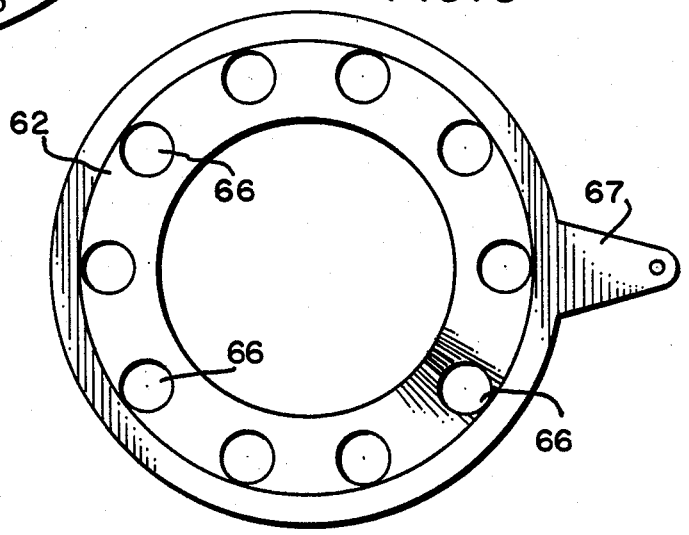

BLENDER BULK FEED VALVE

BACKGROUND OF THE INVENTION

The present invention relates to pneumatic conveying systems and in particular to a material blending system in combination with a pneumatic conveying system. The invention is particularly applicable for use in achieving a homogeneous quantity of material such as pellets, powders and granular material.

In particular, the invention relates to an improvement upon prior U.S. Patent Application Ser. No. 444,636 filed Nov. 26, 1982. In that prior application, there is disclosed a blender which combines pneumatic conveying and material blending into a system and method wherein the blender consists of a vessel having a vertically oriented central column open at both ends and spaced from the bottom of the vessel. The vessel includes a bottom inlet which is coaxially aligned with the vertically oriented column. Material to be blended is pneumatically conveyed from a source to the bottom inlet upwardly through the column and is discharged from the top of the column in a geyser-like manner into the vessel. At the same time, material already in the bin flows downwardly through the bin and is entrained in the upwardly flowing gas stream and fresh particulate material to be blended so that the fresh solid particulate and the solid particulate material already in the bin are disbursed on the top of the material to thereby blend or homogenize the material.

In order to achieve a proper blending of material, it is necessary to provide a means for controlling the blender. This control is performed by controlling the flow of material already in the bin downwardly through the bin or vessel to thereby control the quantity of material entrained into the upwardly flowing gas stream.

Prior to the present invention, it was known to utilize a valve arrangement for controlling the flow out of a blending apparatus. U.S. Pat. No. 4,194,845 issued Mar. 25, 1980, utilizes a central column to divide a blending vessel into a pair of outlets with a valve means controlling the flow out of those separate outlets. The object of that invention is to control the quantity of material which is withdrawn from individual portions of the bin and admitted into the conveying gas stream. In this prior patent, a single bin is divided into a plurality of bins by means of baffles. Blending is achieved by withdrawing material from the separate bins at controlled rates. This is similar in concept to the U.S. Pat. No. 3,145,975 issued Aug. 5, 1964.

According to the present invention, blending is achieved by withdrawing material from the entire bin at a uniform rate and allowing this material to be entrained into a stream of fresh material being supplied to the bin.

SUMMARY

It is a principal object of this invention to provide a process and apparatus for blending solid particulate materials such as pellets, granules, pellets or powders which provides simplified construction and maximum utilization of energy.

It is a further object of this invention to provide a pneumatic conveying and material blending system and method which utilizes the energy used for pneumatic conveying to achieve the blending of the material and utilizes a simple valve arrangement for controlling the blending operation.

In general, the foregoing and other objects will be carried out by providing a pneumatic conveying and material blending system including a vertically oriented vessel having sidewalls, a bottom and a top and an inlet for solid particulate material in the bottom; a hollow, open-ended vertically oriented column mounted in said bin, spaced from and coaxially aligned with the inlet for material; means for supplying a stream of gaseous fluid and fresh solid particulate material to be blended to said inlet for flow upwardly through said column and for selectively entraining solid particulate material already in the vessel and conveying said fresh material and entrained material upwardly through the column whereby said fresh solid particulate material and solid particulate material already in the vessel which is entrained in the stream of gaseous fluid are disbursed onto the top surface of the material in the vessel to thereby blend the material; and means for controlling the quantity of material already in the vessel which is entrained into the stream of fresh solid particulate material flowing upwardly through this column.

The foregoing and other objects will also be carried out by providing a method of conveying and blending particulate material comprising the steps of providing a vessel having an inlet in the bottom thereof and a hollow open-ended vertical column mounted therein aligned with the inlet and spaced from the bottom of the vessel; establishing a flow of gaseous fluid through a conveying line to said inlet of the vessel; introducing fresh particulate material into the flow of gaseous fluid whereby the fresh particulate material is entrained in the gaseous fluid and conveyed to the inlet of the vessel and upwardly through the column and discharged from the top of the column in a geyser-like manner into the vessel; after the vessel is partially filled with particulate materal, introducing particulate material already in the vessel into the fresh particulate material being conveyed upwardly through the column to blend material already in the bin with fresh material.

BRIEF DESCRIPTION OF THE DRAWINGS

The invention will be described in connection with the annexed drawings wherein:

FIG. 1 is a diagrammatic view of a pneumatic conveying and blending system according to the present invention;

FIG. 2 is a sectional view of the inside of the blending vessel according to the present invention;

FIG. 3 is a sectional view on an enlarged scale of a portion of the vessel shown in FIG. 2;

FIG. 4 is a view taken on the line 4—4 of FIG. 3 showing a valve mechanism according to the present invention;

FIG. 5 is a view of a portion of the valve shown in FIG. 4;

FIG. 6 is a view of another portion of the valve shown in FIG. 4;

FIG. 7 is a fragmentary view of a portion of the valve shown in FIG. 4 in a different operative position;

DESCRIPTION OF THE PREFERRED EMBODIMENTS

Figure 8:
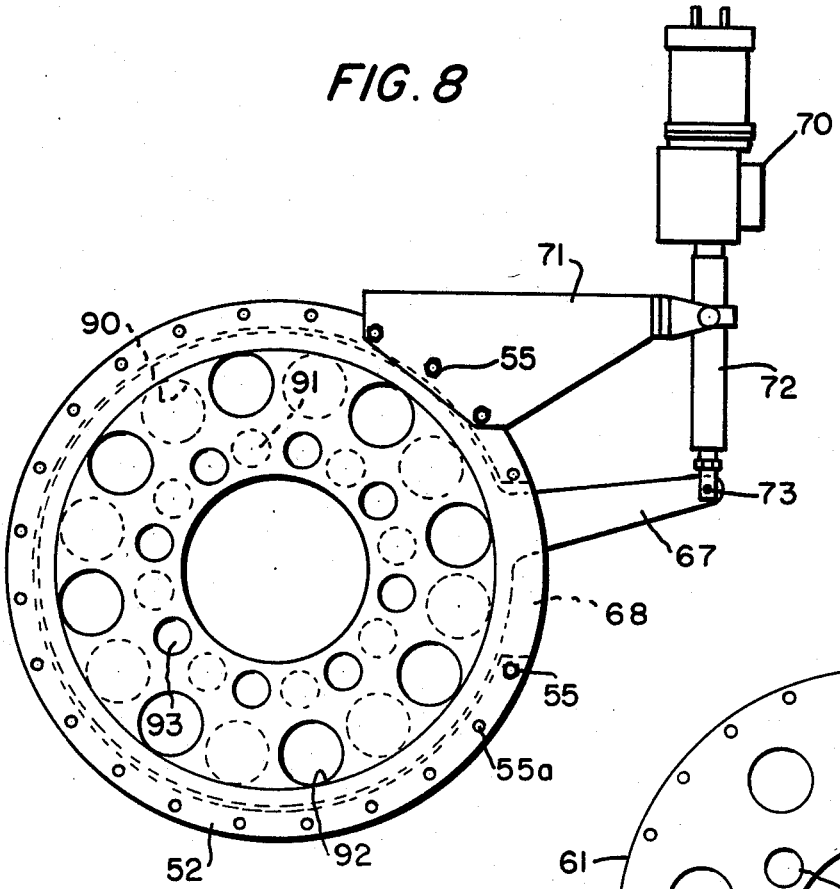
FIG. 8 is a view of a modified valve arrangement according to the present invention.

Referring initially to FIG. 1, there is shown a pneumatic conveying and blending system according to the present invention. The system includes a pneumatic conveying system generally indicated at 1, a blending vessel generally indicated at 2 and a dust collection system generally indicated at 3.

The pneumatic conveying system includes a source of solid particulate material to be blended such as bin 5 having an outlet 6 controlled by a valve diagrammatically indicated at 7 for controlling the flow of solid particulate material to be blended into a pneumatic conveying line 8. A blower 9 driven by a motor 10 supplies gaseous fluid such as air under pressure to the pneumatic conveying line 8 for entraining fresh solid particulate material to be blended and conveying such material through the line 8 to the blending bin 2. Such a pneumatic conveying system is well known to those having ordinary skill in the art. While a blower 9 has been illustrated, it will be understood by those skilled in the art that other sources of gas under pressure such as plant air or a source of intert gas can be used for conveying.

The blending vessel 2 is shown in greater detail in FIG. 2 and includes a bin 15 having a conical bottom 16 with a recirculation section generally indicated at 17. A material inlet 19 is centrally located in the bottom of the vessel. The vessel or bin also includes a vent 20 in the top thereof. A source of booster gas may be connected at 18 to circumferentially spaced apart points around the section 17.

An open ended vertically oriented column 25 is mounted in the bin 15. Any suitable means such as longitudinally spaced apart mounting brackets 26 may be used for this purpose. The column 25 has an upper portion 31 and a lower end 30 spaced from the bottom of the vessel and the section 17.

A deflector or distributor means 35 is also mounted within the bin 15. This deflector may take the form of a "Chinese hat" at the top thereof as indicated at 36 and a conical portion 37 pointed downwardly towards and spaced from the top 31 of the column 25. The deflector means 35 is mounted by means of brackets 38 and 39. Other suitable arrangements for mounting the deflector are contemplated by the present invention and will be apparent to those skilled in the art.

The bin 15 includes an outlet which is integral with the inlet 19. The outlet is actually formed by material conveying conduit 40 which meets the pneumatic conveying line 8 at diverter valve 41 positioned in conveying line 8. Diverter valves are known to those skilled in the art and can be adjusted between a position which permits material to be supplied to the vessel through conduit 8 and inlet 19 and to a position which permits material to be withdrawn from the vessel through inlet/outlet 19 and the branch line 40 which serves of the outlet of the vessel. A cutoff valve 43 may also be used in the inlet/outlet 19.

The bottom 16 of the vessel includes means 50 for controlling the quantity of material already in the vessel which is entrained into the stream of gaseous fluid and fresh solid particulate material being supplied to the bin. This means 50 and its alternate embodiments are illustrated in detail in FIGS. 3 to 10.

As illustrated in FIG. 3, at the lower end or bottom 16 of the vessel 15, there is a cylindrical portion 51 including a flange 52. A conical member 53 having an annular flange 54 is secured to the bin 15 through flange 52 by any suitable means such as bolts 55. The conical portion 53 defines inlet/outlet 19 of the vessel 15.

An annular valve generally indicated at 60 is positioned between the cylindrcial portion 51 of bin 15 and the conical member 53. This annular valve means surrounds the lower end 30 of the column 25 and is positioned between the sidewalls of the vessel 15 and the vertical column 25. The valve 60 includes a first annular disc 61 and a second annular disc 62 lying atop the first annular disc 61. A downwardly extending annular member 63 may be used to secure the disc member 61 to the column 25.

Referring to FIGS. 5 and 6, the annular disc 61 includes a plurality of circumferentially spaced apart openings 65 therethrough and is secured to the flanges 54 and 52 by means of the bolts 55 which extend through circumferentially spaced apart openings **55*a* in disc 61. The second annular disc 62 is illustrated in FIG. 6 and includes a plurality of circumferentially spaced apart openings 66 therethrough. The opening 66 are of the same diameter and spaced apart a distance equal to the openings 65 in the disc 61. The disc 62 includes an ear 67. The member 17 includes an opening 68 which is positioned to permit the ear 67 to extend outside of the vessel 15 as illustrated in FIGS. 4 and 7**.

The assembly includes control means for rotating the second disc 62 relative to the first disc 61 for selectively aligning the openings 65 in the first disc with the openings 66 in the second disc for controlling the quantity of material in the vessel 15 above valve member 60 which can flow into the hopper section 17 below the valve 60. As will be apparent hereafter this will control the quantity of material already in the vessel which is entrained into a stream of gaseous fluid flowing upwardly through the column and the blending of material. In FIG. 4, this control means is illustrated as a pneumatic or hydraulically actuated piston-cylinder arrangement 70 mounted by means of a bracket 71 on the vessel 15. The piston rod 72 is connected to the ear 67 by means of a pin 73. In the position in FIG. 7, the openings 65 are not aligned with the openings 66 to prevent material flow whereas in the position illustrated in FIG. 4 the openings 65 and 66 are aligned to permit material flow.

In operation, the method of conveying and blending solid particulate material is carried out by establishing a flow of gaseous fluid from the source such as blower 9 through conveying line 8 to inlet 19 of vessel 15. Fresh solid particulate material to be blended is introduced into the flow of gaseous fluid from the source 5 through the valve 7 into the pneumatic conveying line 8 where the material is entrained in the gaseous fluid and conveyed through conveying line 8 and diverter valve 41 past open cutoff gate 43 to inlet 19 of vessel 15. The energy of the gas under pressure used to convey the material to the vessel serves to convey the fresh solid particulate material up through column 25. As the material is conveyed through the column it is discharged out of the column in a geyser-like manner to be disbursed outwardly by the diverter means 35 into the bin where it falls down into the vessel.

The use of the bottom filling of the vessel eleminates the need for external piping up the side of the vessel and the need for transfer points and associated valving at the top of the vessel where maintenance can be a problem.

During the initial stage of conveying, the disc 62 is rotated to the position shown in FIG. 7 so that the openings 65/66 are closed. After the vessel is partially filled with particulate material, the cylinder 70 is actuated to rotate the valve disc 62 to the position shown in FIG. 4 to allow particulate material already in the vessel to fall through these openings and the annular area 80 between the column 25 and walls 53 of hopper portion defined by walls 53. Within the hopper portion 53, the material already in the vessel is entrained in the gas stream and the fresh particulate being conveyed upwardly through the column 25. As a result, material already in the bin is mixed with the fresh material being suppied to the vessel. It is desirable to have available some means for increasing the flow of material already in the bin into the recirculation zone 17 to enable such material to be conveyed up the column 25. This means has been illustrated as the booster gas supply at 18. A pressure sensor may be utilized to indicate pressures in line 8. When a high line pressure is encountered, it will indicate too high a quantity of material already in the bin being supplied to the bottom of the column 25 and the cylinder 70 can be actuated to partially close the openings 65/66 thereby reducing the quantity of material supplied from the bin to the bottom of the column. Thus it can be seen that a means has been provided for controlling fresh material being supplied to the bin and thereby control blending.

Figure 9:
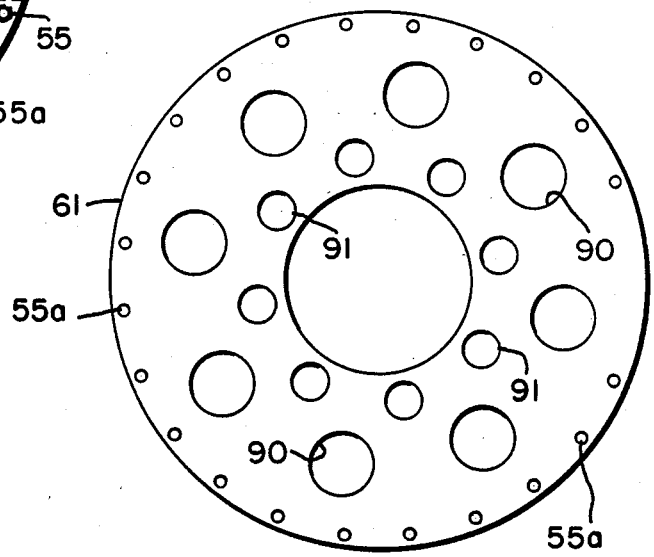
FIG. 9 is a view of a portion of the valve shown in FIG. 8.
Figure 10:
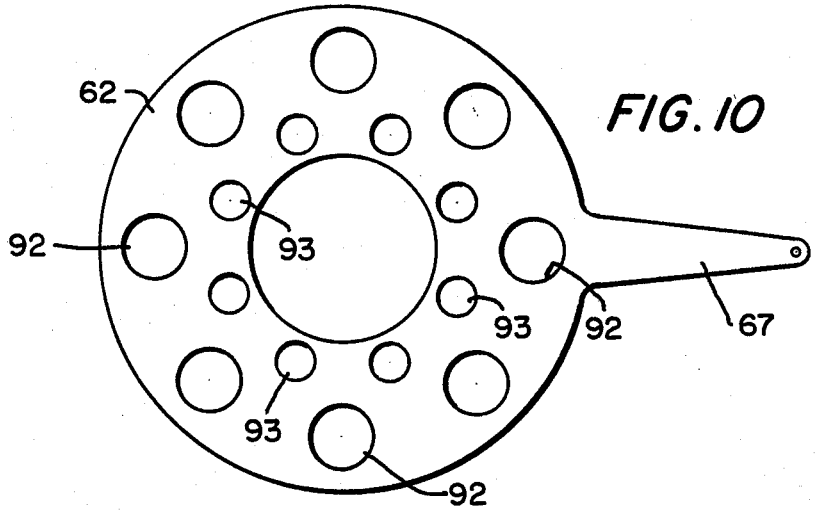
FIG. 10 is a view of another portion of the valve shown in FIG. 8.

The embodiment illustrated in FIGS. 8 to 10 is similar to that shown in FIGS. 4 to 6 and like numerals are used to indicate like parts for the embodiment of FIGS. 8 to 10, a slightly different mounting for cylinder 70 is used and the valve discs 61 and 62 are provided with two rows 90 and 91 of openings in disc 61 and two rows of openings 92 and 93 in disc 62. When the valve is open to permit material flow, openings 90 and 92 are aligned and openings 91 and 93 are aligned. The added opening increase the quantity of material already in the vessel being supplied to the bottom of the column.

From the foregoing it should be apparent that the objects of the invention have been carried out. An arrangement has been provided for blending particulate material which includes an arrangement for controlling the quantity of material already in the bin which is blended with fresh material being supplied to the bin. It should be understood that the disc 62 could be rotated to an intermediate position so that the openings 65 and 66 in FIGS. 4 to 6 or openings 90/91 and 92/93 in FIGS. 7 to 10 are partially aligned to control material flow at an intermediate rate.

It is intended that the foregoing be a description of preferred embodiments and that the invention be limited solely by that which is within the scope of the appended claims.

We claim:

1. A pneumatic conveying and material blending system including a vertically oriented vessel having sidewalls, a bottom and a top and an inlet for solid particulate material in the bottom; a hollow, open-ended vertically oriented column mounted in said bin, spaced from and coaxially aligned with the inlet for material; means for supplying a stream of gaseous fluid and fresh solid particulate material to be blended to said inlet for flow upwardly through said column and for selectively entraining solid particulate material already in the vessel and conveying said fresh material and entrained material upwardly through the column whereby said fresh solid particulate material and solid particulate material already in the vessel which is entrained in the stream of gaseous fluid are dispersed onto the top surface of material in the vessel to thereby blend the material; and means for controlling the quantity of material already in the vessel which is entrained into the stream of fresh solid particulate material flowing upwardly through the column.

2. A pneumatic conveying and material blending system according to claim 1 wherein said last named means is an annular valve positioned near the bottom of said vessel surrounding said column.

3. A pneumatic conveying and material blending system according to claim 2 wherein said annular valve includes a first annular disc having a plurality of space apart openings therethrough, a second annular disc having a plurality of spaced apart openings therethrough, and means for rotating said second disc relative to said first disc for selectively aligning the opening in said first disc with the openings in said second disc for controlling the quantity of material already in the vessel which is entrained into the stream of fresh solid particulate material flowing upwardly through the column.

4. A pneumatic conveying and material blending system according to claim 3 wherein there are at least two rows of circumferentially spaced apart openings in each of said first and second discs to permit a mass flow of material in the vessel surrounding the column downwardly through the vessel.

5. A pneumatic conveying and material blending system according to claim 4 further comprising means for supplying additional gaseous fluid to said vessel adjacent said column below said valve means.

6. A method of conveying and blending particulate material comprising the steps of:

providing a vessel having an inlet in the bottom thereof and a hollow open-ended vertical column mounted therein aligned with the inlet and spaced from the bottom of the vessel;

establishing a flow of gaseous fluid through a conveying line to said inlet of the vessel;

introducing fresh particulate material into the flow of gaseous fluid whereby the fresh particulate material is entrained in the gaseous fluid and conveyed to the inlet of the vessel and upwardly through the column and discharged from the top of the column in a geyser like manner into the vessel;

after the vessel is partially filled with particulate material, introducing particulate material already in the vessel into the fresh particulate material being conveyed upwardly through the column to blend material already in the bin with fresh material.

7. A method of conveying and blending particulate material according to claim 6 further comprising the steps of withdrawing material from the vessel, introducing the withdrawn material into the flow of gaseous fluid and conveying the withdrawn material to a remote point.

8. A method of conveying and blending particulate material according to claim 6 further comprising the step of controlling the rate at which material already in the vessel is introduced into the fresh material being conveyed upwardly through the column.

9. A method of conveying and blending particulate material according to claim 6 further comprising the step of sensing the pressure of gaseous fluid in the conveying line and controlling the rate at which material already in the vessel is introduced into the fresh material being conveyed upwardly through the column in response to the sensed pressure.

* * * * *